US006974369B2

(12) United States Patent
Mizun

(10) Patent No.: US 6,974,369 B2
(45) Date of Patent: Dec. 13, 2005

(54) GRINDING WATER TANK UNIT FOR EYEGLASS LENS PROCESSING AND EYEGLASS LENS PROCESSING APPARATUS HAVING THE SAME

(75) Inventor: Toshiaki Mizun, Aichi (JP)

(73) Assignee: Nidek Co., Ltd., Aichi (JP)

( * ) Notice: Subject to any disclaimer, the term of this patent is extended or adjusted under 35 U.S.C. 154(b) by 250 days.

(21) Appl. No.: 10/650,844

(22) Filed: Aug. 29, 2003

(65) Prior Publication Data

US 2004/0053564 A1 Mar. 18, 2004

(30) Foreign Application Priority Data

Aug. 30, 2002 (JP) ..... P2002-253946

(51) Int. Cl.[7] ..... B24B 7/30

(52) U.S. Cl. ..... 451/255; 451/444; 451/450; 451/453; 210/349; 210/353; 210/188

(58) Field of Search ..... 451/36, 42, 43, 451/44, 60, 87, 88, 255, 256, 444, 446, 449, 451/450, 453; 210/767, 805, 498, 349, 353, 210/151, 174, 188

(56) References Cited

U.S. PATENT DOCUMENTS

| | | | | |
|---|---|---|---|---|
| 3,651,607 | A * | 3/1972 | Lee, II | 451/453 |
| 4,084,944 | A * | 4/1978 | Chirico | 95/257 |
| RE35,898 | E | 9/1998 | Shibata et al. | |
| 6,106,728 | A * | 8/2000 | Iida et al. | 210/743 |
| 6,461,524 | B1 * | 10/2002 | Tsuihiji et al. | 210/777 |
| 6,672,948 | B2 * | 1/2004 | Mizuno | 451/60 |
| 2002/0132568 | A1 | 9/2002 | Mizuno | |
| 2003/0017791 | A1 | 1/2003 | Mizuno | |

FOREIGN PATENT DOCUMENTS

| | | | |
|---|---|---|---|
| DE | 42 35 767 | A1 | 9/1994 |
| DE | 44 26 419 | C1 | 4/1996 |
| JP | 5-212661 | A | 8/1993 |
| JP | 2514215 | Y2 | 7/1996 |
| JP | 11-320408 | A | 11/1999 |
| JP | 02000288934 | A * | 10/2000 |

OTHER PUBLICATIONS

Japanese Abstract No. 2002224957, dated Aug. 13, 2002.
Japanese Abstract No. 11320408, dated Nov. 24, 1999.

* cited by examiner

*Primary Examiner*—Eileen P. Morgan
(74) *Attorney, Agent, or Firm*—Sughrue Mion, PLLC

(57) ABSTRACT

An eyeglass lens processing apparatus for processing an eyeglass lens includes: a processing chamber inside which a lens grinding tool is disposed; a tank which stores grinding water; a drain hose connecting the processing chamber with the tank; a filter for eliminating bubbles attached to an outlet of the drain hose, which includes a large number of pores having a size such that permits passing of processing debris stemming from rough processing and inhibits passing of bubbles larger than the processing debris.

10 Claims, 1 Drawing Sheet

GRINDING WATER TANK UNIT FOR EYEGLASS LENS PROCESSING AND EYEGLASS LENS PROCESSING APPARATUS HAVING THE SAME

BACKGROUND OF THE INVENTION

1. Field of the Invention

The present invention relates to an eyeglass lens processing apparatus for processing an eyeglass lens, and to a grinding water tank unit for storing and circulating grinding water used at the time of lens processing.

2. Description of Related Art

In an eyeglass lens processing apparatus, grinding water is supplied during processing so as to cool the ground portion of a lens and eliminate grinding debris from the lens. As this water supplying system, there is a system in which grinding water is circulated between a grinding water tank and the main body of the processing apparatus. In this system, the grinding water stored in the tank is pumped up by a pump and supplied to the main body of the processing apparatus, the grinding water after use is discharged (drained) into the tank and is reused by being circulated.

If a plastic lens is ground by a grinding wheel, the grinding water, particulates of grinding debris and air cause bubbles to be generated in the discharged grinding water. If the grinding is continued, there are cases where the bubbles and the grinding water overflow the tank, or the bubbles and the grinding water flow into the grinding chamber of the main body of the processing apparatus. For this reason, generally, anti-foaming agent (surface active agent) is mixed with the grinding water and the mixture is used in order to restrain a generation of the bubbles.

However, if using the anti-foaming agent, the grinding water tends to be turbid. If the turbid grinding water continues to be circulated and used, processing quality may deteriorate and troubles of the processing apparatus are liable to occur. Further, recently, in term of the environment issue, it becomes necessary to restrain use of surface-active agent inclusive of the anti-foaming agent. In case of no use of anti-foaming agent, since the tank is filled with the bubbles by processing a small number of lenses, replacement of grinding water in the tank should be frequently conducted.

SUMMARY OF THE INVENTION

In view of the above-described problems of the related art, it is an object of the present invention to provide a unit capable of efficiently restraining the bubbles stored in the tank.

In order to solve the aforesaid object, the invention is characterized by having the following arrangement.

Aspect 1. A grinding water tank unit capable of reuse of grinding water used in processing of an eyeglass lens comprising:

a tank which stores the grinding water;

a filter for eliminating bubbles attached to an outlet of a drain hose connecting a processing chamber of an eyeglass lens processing apparatus, which has a large number of pores having a size such that permits passing of processing debris discharged during rough processing and inhibits passing of the bubbles larger than the processing debris.

Aspect 2. The grinding water tank unit according to the aspect 1, wherein the filter has the pores having a diameter of approximately 0.3 to 1.5 mm.

Aspect 3. The grinding water tank unit according to the aspect 1, wherein the filter has a bag shape having an elastic mesh structure Aspect 4. The grinding water tank unit according to the aspect 1, wherein the tank unit is disposed below the eyeglass lens processing apparatus, and the filter traps the bubbles flowing down through the drain hose, and the grinding water flowing down through the drain hose comes into collision with the trapped bubbles, thereby breaking the trapped bubbles.

Aspect 5. The grinding water tank unit according to the aspect 1 further comprising a cover detachable from an upper portion of the tank, which has a connection port to which the outlet of the drain hose is connected, wherein the filter is attached to the connection port.

Aspect 6. An eyeglass lens processing apparatus for processing an eyeglass lens comprising:

a processing chamber inside which a lens grinding tool is disposed;

a tank which stores grinding water;

a drain hose which connects the processing chamber with the tank;

a filter for eliminating bubbles attached to an outlet of the drain hose, which has a large number of pores having a size such that permits passing of processing debris discharged during rough processing and inhibits passing of the bubbles larger than the processing debris.

Aspect 7. The eyeglass lens processing apparatus according to the aspect 6, wherein the filter has the pores having a diameter of approximately 0.3 to 1.5 mm.

Aspect 8. The eyeglass lens processing apparatus according to the aspect 6, wherein the filter has a bag shape having an elastic mesh structure Aspect 9. The eyeglass lens processing apparatus according to the aspect 6, wherein the tank unit is disposed below the eyeglass lens processing apparatus, and the filter traps the bubbles flowing down through the drain hose, and the grinding water flowing down through the drain hose comes into collision with the trapped bubbles, thereby breaking the trapped bubbles.

Aspect 10. The eyeglass lens processing apparatus according to the aspect 6 further comprising a cover detachable from an upper portion of the tank, which has a connection port to which the outlet of the drain hose is connected, wherein the filter is attached to the connection port.

The present disclosure relates to the subject matter contained in Japanese patent application No. 2002-253946 (filed on Aug. 30, 2002), which is expressly incorporated herein by reference in their entireties.

DESCRIPTION OF THE PREFERRED EMBODIMENT

Figure 1:
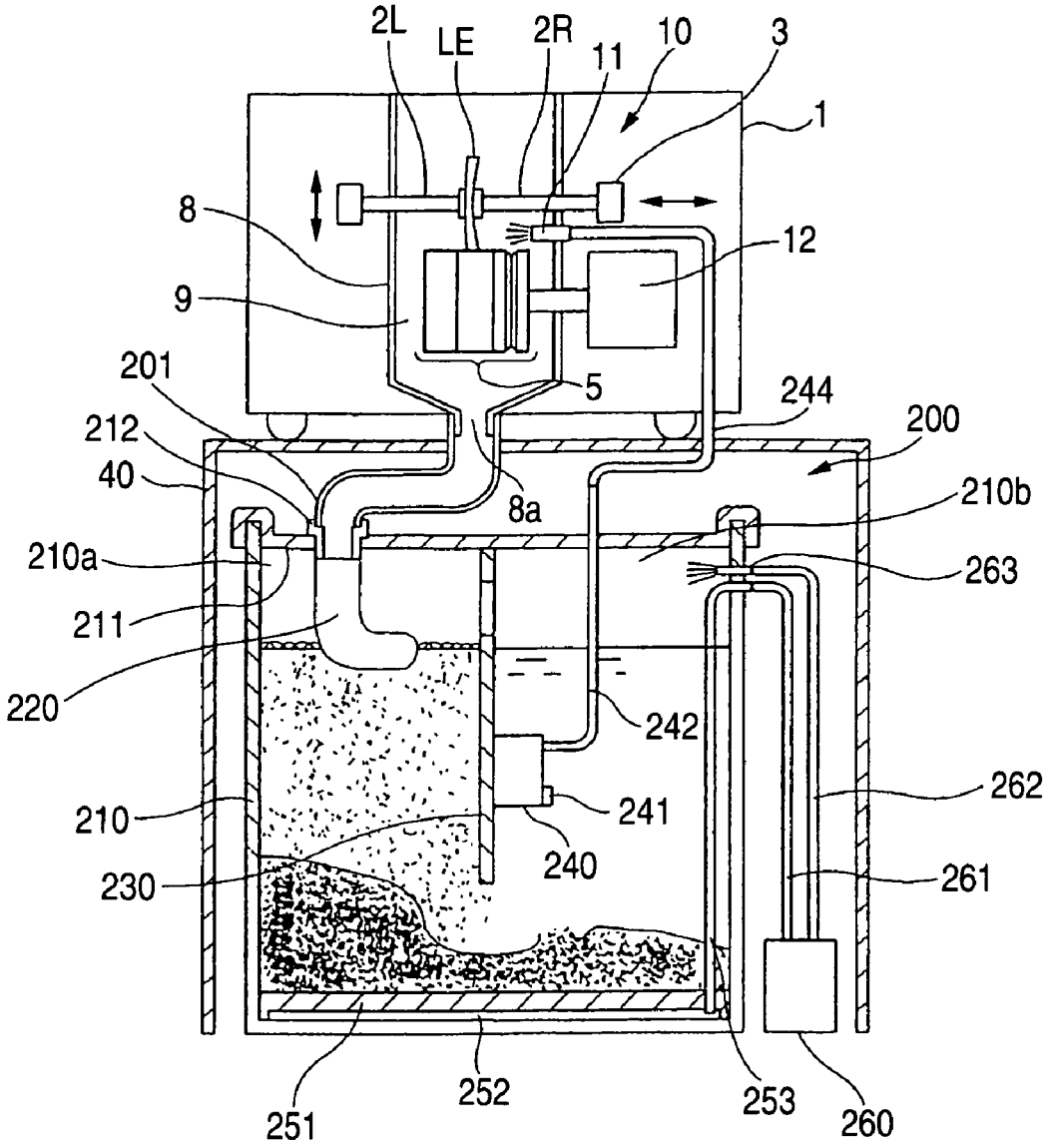
FIG. 1 is an overall schematic diagram of an eyeglass lens processing apparatus.

Referring now to the accompanying drawings, a description will be given of an embodiment of the invention. FIG. 1 is a schematic diagram of an entire eyeglass lens processing apparatus in accordance with the invention. The processing apparatus is mainly comprised of a main body 1 of the processing apparatus, a table 40 for placing the main body 1 thereon, and a grinding water tank unit 200 disposed inside the table 40.

A processing section 10, which includes two lens rotating shafts (chuck shafts) 2R and 2L for holding a subject lens LE, a carriage section 3 to which the lens rotating shafts 2R and 2L are rotatably attached, a grinding wheel 5 attached to a rotating shaft of a motor 12 for grinding a peripheral edge of the lens LE, and the like, is disposed inside the casing of the main body 1. The carriage section 3 is arranged to be movable in the axial direction of the lens rotating shafts 2R and 2L and relatively movable with respect to the grinding wheel 5. For the details of the processing section 10, reference should be made to Re. 35,898 (JP-A-5-212661) and the like.

In addition, a processing chamber 9 is formed inside the main body 1 by a waterproof cover 8 in such a manner as to surround the lens LE held by the lens rotating shafts 2R and 2L as well as the grinding wheel 5. A nozzle 11 for jetting grinding water extends in this processing chamber 9. A drain hose (tube) 201 is connected to a drain port 8*a* located in a lower portion of the cover 8, and extends to a side of a grinding water storage tank 210 of the tank unit 200.

The tank 210 has a cylindrical shape with a bottom, and has a volume of 20 liter. It should be noted that the tank 210 may not be cylindrical in shape, but may be box-shaped. A cover 211 which substantially seals the inside of the tank 210 is removably fitted (mounted) to an opening section formed in an upper portion of the tank 210. A partition plate 230 for partitioning the interior of the tank 210 into a drain chamber 210*a* and a water suction chamber 210*b* is fixed in the vicinity of the center of the cover 211. Gaps (openings) for securing a flow path through which the grinding water flows are formed between a side inner surface of the tank 210 and a side end portion of the partition plate 230 and between a bottom inner surface of the tank 210 and a lower end portion of the partition plate 230, respectively (the drain chamber 210*a* and the water suction chamber 210*b* are partially connected each other).

A connection port 212 is provided on the cover 211 at the drain chamber 210*a* side. A filter 220 for eliminating bubbles is removably attached to the connection port 212 by means of an attaching member, such as a band. The grinding water introduced by way of the hose 201 is charged into the filter 220 suspended below the connection port 212.

The filter 220 will be described. The filter 220 is of a bag shape having a diameter (50 to 60 mm) substantially as large as that of the connection port 212. The length of the filter 220 is at least 100 mm, and the filter 220 long enough to reach the grinding water stored in the tank 210 is preferable. The filter 220 used in the embodiment has a length of approximately 300 mm. Further, the filter 220 has a mesh structure, and thereby has a large number of pores (mesh). Each pore is of a size such that permits passing of processing debris discharged (generated) during rough processing of a plastic lens and inhibits passing of bubbles larger than processing debris. In terms of dimension, each pore preferably has a diameter of approximately 0.3 to 1.5 mm, and more preferably a diameter of approximately 0.5 to 1.0 mm. The filter 220 is made of fibers of elastic synthetic resin. An elastic filter can be formed, for example, from thin fibers and by the knitting method used for stockings (panty hose).

A submerged pump 240 to be used for circulating water is secured on the partition plate 230 at the water suction chamber 210*b* side of the partition plate 230. The partition plate 230 serves as a stationary member to be used for fixing the pump 240 to a position inside (or below) the cover 211. A water suction port 241 of the submerged pump 240 is located at a position under about one-third the height of water in the tank 210. The water suction port 241 draws water having a smaller amount of suspended debris and prevents suction of precipitated debris. The water drawn by the pump 240 is delivered to the outside of the tank 210 through a hose 242. The water is further delivered to the nozzle 11 through a water supply hose 244 connected to the hose 242.

A filtration filter 251 is disposed at the bottom of the tank 210 for facilitating precipitation of debris and separating the debris from grinding water. The filter 251 is a plate having the same cross-sectional profile as that of the tank 210; that is, a disk shape. The debris is accumulated on the filter 251. A hollow section 252 is defined between the bottom surface of the tank 210 and the filter 251. A suction pipe 253 is connected to the hollow section 252. The hollow section 252 is constituted by forming grooves in the lower surface of the filtration filter 251 in a lattice pattern. The suction pipe 253 extends to the outside of the tank 210, and a hose 261 extended from the suction pump 260 is connected to the connection portion of the pipe 253. The grinding water which the pump 260 sucks through the pipe 253 and the hose 261 is returned in the tank 210 from a connection port 263 attached to the side surface of the tank 210 through a hose 262.

Sintered porous plastic formed by sintering plastic beads is employed as the filter 251, since the porous plastic is light weight and has superior durability and machinability. Here, the sintered porous plastic is formed from any of the following raw materials; that is, polyethylene, polypropylene, and ethylene-vinyl acetate copolymer. A pore of the filtration filter 251 has a diameter about 15 $\mu$m.

Next, use of the grinding water tank unit and the eyeglass lens processing apparatus having the unit as discussed above will be described. The filter 220 is attached to the connection port 212 of the drain hose 201 extending from the main unit 1. Grinding water is stored in the tank 210 such that an interval of 10 cm or more is maintained between a water surface of the grinding water and the connection port 212 and the filter 220 comes above the water surface. It should be noted that an antifoaming agent is usually added to the grinding water in suppressing generation of bubbles; however, in order to avoid a problem that processing debris causes turbidity in the grinding water or the like, no antifoaming agent is employed in the embodiment.

When the main unit 1 has started processing the lens LE, the control section in the main unit 1 drives the pump 240, whereby the grinding water pumped up from the water suction chamber 210*b* is jetted into the processing chamber 9 by way of the nozzle 11. The thus-jet grinding water and the processing debris are received by the cover 8, and discharged (drained) into the filter 220 attached to the connection port 212 by way of the drain hole 8*a* and the drain hose 201.

Fine particles of the processing debris discharged during processing of the plastic lens, grinding water, and air produce bubbles. An air layer has been formed on the surface of the grinding wheel 5 as a result of high-speed rotation of the grinding wheel 5, and water and air are mixed together by addition of grinding water for cooling purpose to the air layer. Hence, water and air are simultaneously discharged from the drain hose 201. Debris of 1 mm or smaller that dissolves neither in air nor water forms bubbles. Once bubbles are formed, processing debris of a large particle size adheres to the bubbles, and the accumulation forms larger bubbles.

In a case where a plastic lens made of a typical material, CR-39, is subjected to rough processing, powdery processing debris is generated because CR-39 is hard and brittle. The filter 220 permits passing of such processing debris, so that the processing debris will not accumulate inside. On the other hand, because bubbles larger than the processing debris stemming from rough processing are trapped (accumulated) inside the filter 220, it is possible to prevent bubbles from dispersing within the tank 210. Because the bubbles contain a large quantity of air, the bubbles are afloat on the water surface inside the filter 220. The grinding water flowing down from the drain hose 201 comes into collision with these bubbles, thereby agitating the bubbles inside the filter 220. This agitation breaks large bubbles. Larger processing debris in the bubbles is thereby separated from the bubbles, and is then discharged to the outside of the filter 220. A quantity of bubbles being generated can be thus reduced. Although microscopic bubbles that have passed through the filter 220 are present on the water surface outside the filter 220, such bubbles are negligibly small in volume. According to the experiment conducted by the present inventor, a quantity of the bubbles can be reduced to half or less than half the conventional quantity.

Because the filter 220 is of an elastic structure, it is possible to eliminate clogging of processing debris larger than processing debris discharged during processing of CR-39, and passing of such larger processing debris is thus permitted. For example, processing debris discharged during rough processing of a high-refracting lens forms lint of 1 to 2 mm in size, and is readily hooked by pores in the filter 220. However, the filter 220 swells due to the inflow of drainage, and the mesh becomes larger. This also permits passing of processing debris of the high-refracting lens, and clogging can be thus eliminated.

In order to enhance the agitating effect of the bubbles by the drainage from the main unit 1, it is preferable that the drainage vigorously flows into the filter 220 from the main unit 1. Hence, it is more preferable to situate the tank 210 to a location such that secures a larger height difference with respect to the main unit 1.

The processing debris discharged from the filter 220 is heavier than water, and therefore precipitates. Because the drainage chamber 210*a* and the water suction chamber 210*b* are partitioned by the partition plate 230 except for clearances provided partially, the processing debris discharged to the drainage chamber 210*a* side hardly reaches the water suction chamber 210*b* side, and most of the processing debris precipitates on the bottom portion of the tank 210. Further, in order to promote precipitation of the processing debris, the pump 260 is driven at the time of processing in the apparatus. By driving the pump 260, a suction pressure is applied to the hollow section 252 defined below the filter 251, and the grinding water in the tank 210 is separated from the processing debris by the filter 251, and then sucked. The thus-sucked grinding water is returned to the inside of the tank 210 by way of the hose 262. By this suction, the processing debris is attracted toward the filter 251, whereby precipitation of the processing debris is promoted. Further, progress in solidification of the thus-precipitated processing debris suppresses generation of turbidity in the grinding water.

In a case where the processing debris accumulated in the tank 210 is discarded, the hose 262 is disconnected from the connection port 263, and the grinding water sucked by the pump 260 is drained to the outside or into another tank. By discharging the grinding water in the tank 210 by way of the filter 251, the processing debris accumulates on the top portion of the filter 251. Finally, moisture contained in the processing debris is also subjected to suction, and the processing debris is solidified. For this reason, the processing debris alone can be discarded.

As has been described, according to the invention, bubbles accumulated in the tank can be suppressed efficiently even when no antifoaming agent is employed.

What is claimed is:

1. A grinding water tank unit capable of reuse of grinding water used in processing of an eyeglass lens comprising:

a tank which stores the grinding water;

a filter for eliminating bubbles; said filter attached to an outlet of a drain hose which is connected to a processing chamber of an eyeglass lens processing apparatus, said filter having a large number of pores having a size that permits passing of processing debris discharged during rough processing while said pores inhibit passing of bubbles larger than the processing debris.

2. The grinding water tank unit according to claim 1, wherein the filter has the pores having a diameter of approximately 0.3 to 1.5 mm.

3. The grinding water tank unit according to claim 1, wherein the filter has a bag shape having an elastic mesh structure.

4. The grinding water tank unit according to claim 1, wherein the tank unit is disposed below the eyeglass lens processing apparatus, and the filter traps the bubbles flowing down through the drain hose, and the grinding water flowing down through the drain hose comes into collision with the trapped bubbles, thereby breaking the trapped bubbles.

5. The grinding water tank unit according to claim 1 further comprising a cover detachable from an upper portion of the tank, said cover has a connection port to which the outlet of the drain hose is connected, wherein the filter is attached to the connection port.

6. An eyeglass lens processing apparatus for processing an eyeglass lens comprising:

a processing chamber inside which a lens grinding tool is disposed;

a tank which stores grinding water;

a drain hose which connects the processing chamber with the tank;

a filter for eliminating bubbles; said filter attached to an outlet of the drain hose, said filter having a large number of pores having a size that permits passing of processing debris discharged during rough processing while said pores inhibit passing of the bubbles larger than the processing debris.

7. The eyeglass lens processing apparatus according to claim 6, wherein the filter has the pores having a diameter of approximately 0.3 to 1.5 mm.

8. The eyeglass lens processing apparatus according to claim 6, wherein the filter has a bag shape having an elastic mesh structure.

9. The eyeglass lens processing apparatus according to claim 6, wherein the tank unit is disposed below the eyeglass lens processing apparatus, and the filter traps the bubbles flowing down through the drain hose, and the grinding water flowing down through the drain hose comes into collision with the trapped bubbles, thereby breaking the trapped bubbles.

10. The eyeglass lens processing apparatus according to claim 6 further comprising a cover detachable from an upper portion of the tank, said cover has a connection port to which the outlet of the drain hose is connected, wherein the filter is attached to the connection port.

* * * * *